United States Patent [19]

Klaus

[11] 4,239,306

[45] Dec. 16, 1980

[54] FILE FRAME

[75] Inventor: Gerald R. Klaus, St. Charles, Ill.

[73] Assignee: Fellowes Manufacturing Company, Itasca, Ill.

[21] Appl. No.: 963,996

[22] Filed: Nov. 27, 1978

[51] Int. Cl.[3] ..... A47B 87/00; F16B 12/00

[52] U.S. Cl. ..... 312/111; 312/108; 312/259; 312/261; 211/194

[58] Field of Search ..... 312/107, 111, 108, 140, 312/257 R, 257 SK, 259, 261; 211/126, 194; 248/27.1

[56] References Cited

U.S. PATENT DOCUMENTS

| | | | |
|---|---|---|---|
| 1,573,608 | 2/1926 | Huffman | 312/107 |
| 1,686,515 | 10/1928 | Chandler | 312/111 |
| 2,237,176 | 4/1941 | Dorman | 312/107 |
| 2,246,966 | 6/1941 | Zalkind | 312/108 |
| 2,337,079 | 12/1943 | Zalkind | 312/261 |
| 2,362,520 | 11/1944 | Zalkind | 312/108 |
| 2,785,940 | 3/1957 | Felton | 312/111 |
| 3,279,873 | 10/1966 | Gronquist | 312/259 |
| 3,321,259 | 5/1967 | Fiterman et al. | 312/259 |
| 3,494,685 | 2/1970 | Fiterman et al. | 312/108 |
| 3,552,579 | 1/1971 | Simon et al. | 312/108 |
| 3,740,109 | 6/1973 | Pfaffendorf et al. | 312/261 |

FOREIGN PATENT DOCUMENTS

| | | | |
|---|---|---|---|
| 2032572 | 1/1972 | Fed. Rep. of Germany | 211/194 |

*Primary Examiner*—Victor N. Sakran

*Attorney, Agent, or Firm*—Hume, Clement, Brinks, Willian & Olds, Ltd.

[57] ABSTRACT

There is provided a reinforcing frame for an open-ended container, adapted to receive the forward edges of the container at its open end, having at least three channelled sides forming a continuous frame body, and formed each by two spaced-apart leg members interconnected by a base member and at least one rigid bar disposed between adjacent leg members in close proximity to the base member. The bar would be disposed between the base member and a forward edge of a container received by the channelled sides. Also provided is a means for linking adjacent framed shells in the form of a clip that extends about adjacent frames and is held against sliding along the frame front. Further, a unit including a plurality of linked frame shells is provided.

8 Claims, 7 Drawing Figures

FIG. 1
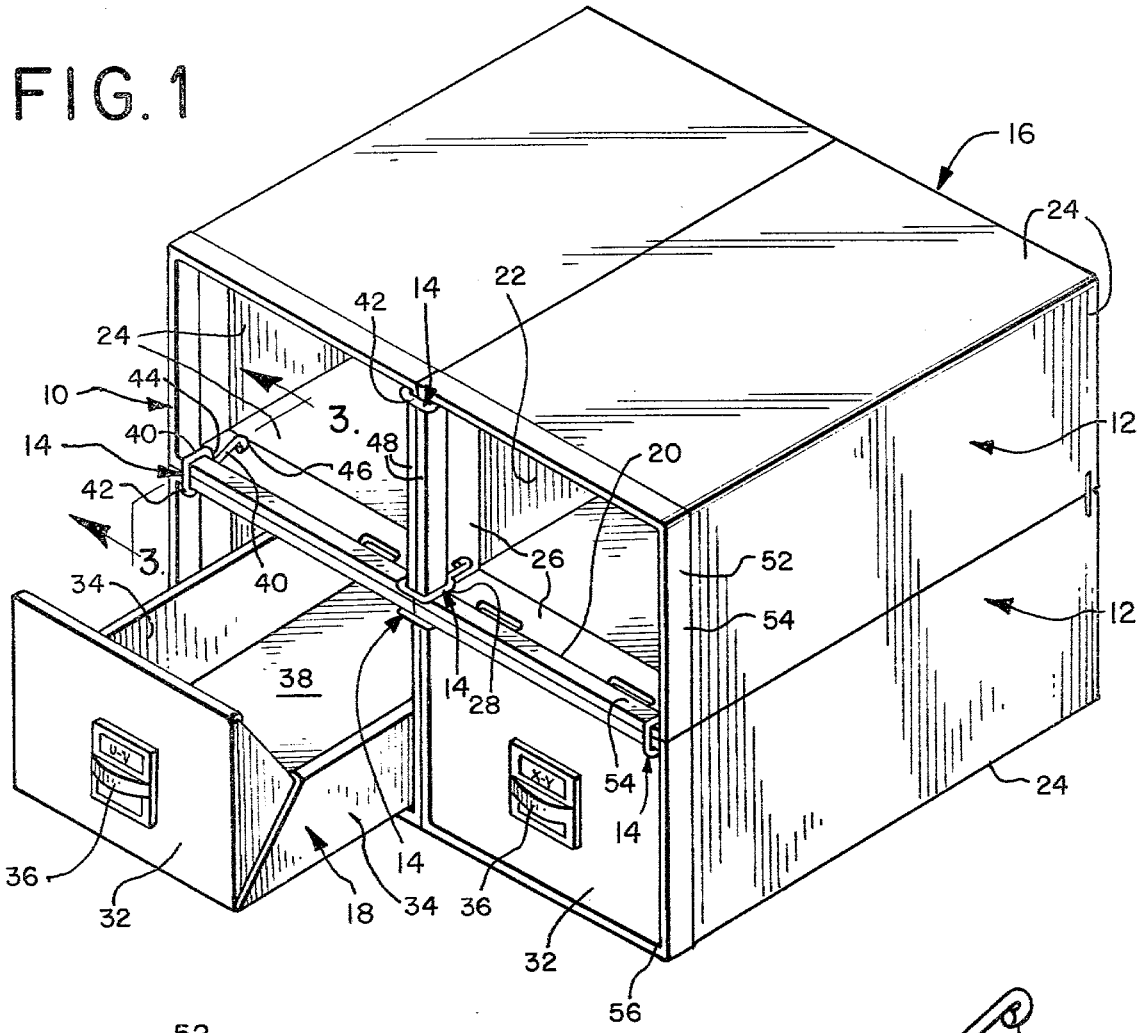
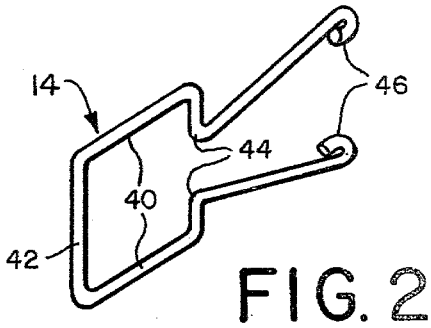
FIG. 2
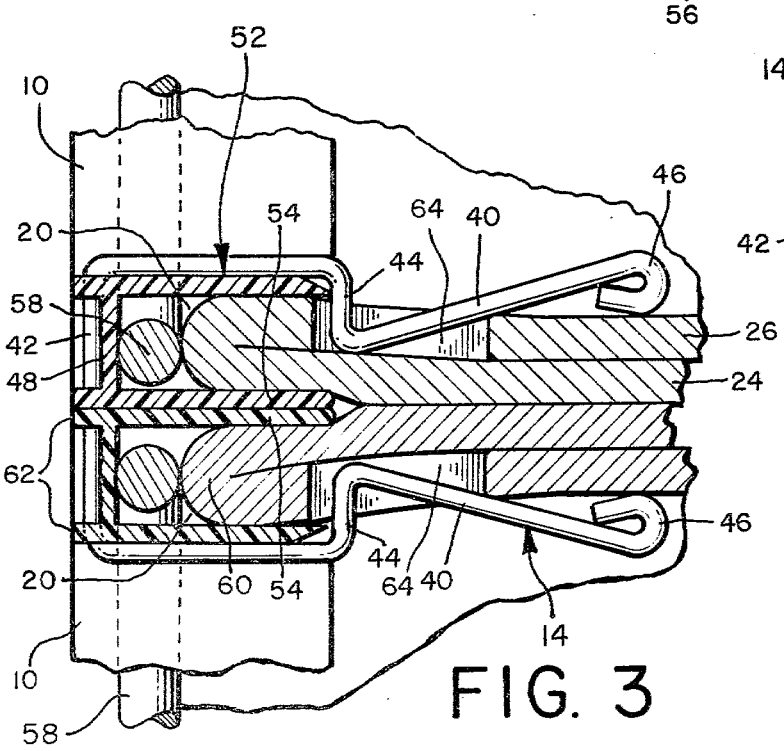
FIG. 3

FILE FRAME

TECHNICAL FIELD

This invention relates to an improved frame for an open-ended container, and an improved combination of a frame and an open-ended container and a container-linking means for the technical field of office supplies, particularly fiberboard storage containers. This field includes storage containers for file drawers and the like, which containers are generally referred to as shells.

BACKGROUND OF THE INVENTION

Open-ended storage containers for file drawers are shells or housing compartments for the drawers. The drawers themselves usually have full front and back walls with cut-down sides extending therebetween. When a drawer is formed of fiberboard, it preferably is formed of a single blank, that is suitably cut, notched, and scored, as is well known to one of ordinary skill in the art.

A shell for such a drawer generally includes four sides forming a top wall, bottom wall, two side walls, and optionally one end wall, leaving at least one open end, which generally is the forward end. Particularly when the shell is made of fiberboard, the open end is formed by folding scored flaps, free-edged extensions of the bottom, top, and side walls, inwardly back upon themselves, leaving a double layered forward edge about the entire open end.

The drawer is slid in and out of the shell through this open end. Frames are sometimes placed about this edge to reinforce the entire shell, at least aiding in maintaining the shell in its proper squared position. Channelled frames that receive the edges of the shell at its open end additionally maintain the integrity of the shell by holding the flaps forming the edges against the wall from which they extend. These frames are external and when used together with a shell having only one open end, cause a stacking problem. The peripheral dimensions of the frame itself are slightly larger than the shell it receives. When stacked, this differential is multiplied and results in vertical stacks wherein the storage containers slope downwardly from front to rear. This effect is of course proportional to the number of storage containers in the stack.

Shells also have been reinforced at their open ends with internal reinforcing bars which have been formed, in some instances, with circular cross sections. Internal reinforcing bars, as the term is being used herein, are sandwiched between layers of the walls near the open end of the shell, such as between a wall and its extension that is folded back upon the wall. These internal reinforcing bars, particularly those having circular cross sections, often are sturdier than external frames. They do not, however, themselves keep the flap extensions in place, as would external channelled frames.

It is often desirable to maintain a plurality of shells for individual drawers together as one unit when in use. A series of shells can be formed as an integral unit, but such a unit would be cumbersome for transportation, or storage when not in use, and would be less versatile than individual drawer shells. Individual shells are therefore often grouped together, side by side, and one above another, in order to maintain related drawer files in close proximity while minimizing space requirements. To avoid accidental displacement of any of the shells from the desired grouping, means for interconnecting a shell to adjacent shells are highly desirable. Securement of a shell to the shells above and below is desirable, as is securement to the shells on the sides. Means for interlocking a shell grouping, to be most efficient, should be sufficiently strong to avoid accidental displacement and yet should be temporary, to allow a shell to be easily removed from the grouping when necessary. The most advantageous means for interlocking shells would have no members protruding outward of the shell that could interfere with the use of a shell singly.

In the technical field of storage compartments, particularly fiberboard storage compartments, ease of handling and durability are the factors to be maximized, while cost is to be minimized. Means for achieving any of these ends, without undue adverse effects on the others, is highly beneficial.

It is an object of the present invention to provide an improved external channelled frame that is as sturdy as an internal reinforcing bar and elminates the stacking problems of external frames, without significantly increasing the expense thereof. It is an object to provide a reinforcing member for an open-ended storage compartment with the advantages of both an external channelled frame and internal reinforcing bar. It is a further object to provide an external frame for an open-ended shell or the like that receives an efficient linking means. It is another object to provide a combination of a frame for an open-ended shell and a removable linking means that leaves no protruding members on the shell or frame when removed.

DISCLOSURE OF THE INVENTION

The foregoing and other objects are realized in accordance to the invention by an external frame for an open-ended compartment, which frame includes a frame body formed with a continuous channel and at least one rigid bar, preferably of circular cross section, disposed within the channel. The frame, when positioned about the edge of the compartment's or shell's open end, encases the edge. The frame is preferably formed with the same peripheral dimensions as the shell, and the shell is notched at the corners of its open end to allow conformation to the frame. The edge is sandwiched between the spaced-part sides of the channel and is disposed rearward of both the channel base (frame front) and the rigid bar. The frame body and rigid bar provide a frame that not only protects the edge from abrasion damage and the like, and maintains the edge-forming flap extensions, if any, if the desired position, but also has the strength of an internal reinforcing member.

The frame is preferably notched about its corners so as to receive at least one chip which links both the frame and the open-ended compartment together with an adjacent one. When suitable notches are provided at all four corners of the frame, the frame and compartment may be linked to similar frames and compartments positioned below, above, or at either side separately, or simultaneously. The clip is easily put on and removed, providing temporary but secure linkage of compartments. When the clip is removed, no protruding members remain on the frame or compartment.

All components of the frame and linking means can be constructed of relatively inexpensive materials yet the frame and linking means are sufficiently durable to withstand both normal and extraordinary use conditions. Both the frame and the linking means are preferably simple to attach and remove, allowing construction of durable units of any number of compartments, which units are nonetheless temporary if so desired.

BRIEF DESCRIPTION OF THE DRAWINGS

FIG. 1 is a perspective view of a unit having a plurality of open-ended compartments including frames and linking means embodying features of the present invention;

FIG. 2 is a perspective view of a clip of the linking means illustrated in FIG. 1;

FIG. 3 is a partially cutaway cross-sectional view of the unit of FIG. 1, illustrating in cross section two linked frames, taken along line 3—3 of FIG. 1;

PREFERRED EMBODIMENTS OF THE INVENTION

Figure 4:
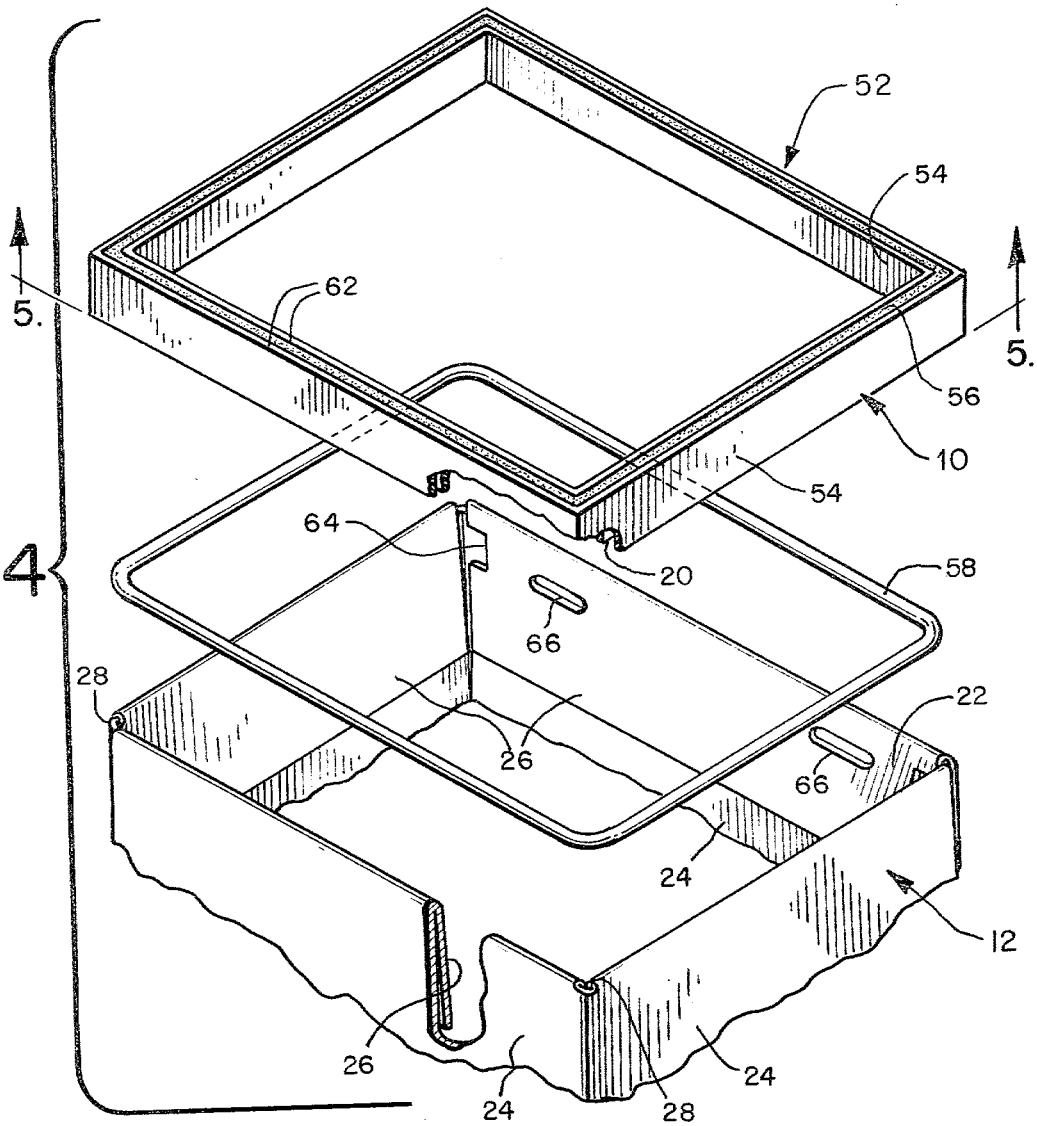
FIG. 4 is an exploded view of a compartment and frame of FIG. 1.

The invention, as illustrated in the drawings with particular reference to FIG. 1, includes a frame, designated generally by the reference numeral 10, for an open-ended compartment such as the drawer shells 12 as illustrated. The shells 12 are shown linked together by clips 14 not only to shells 14 above or below, but also to shells 12 at the side, to form a stable unit, designated generally 16. Each shell 12 can house a file drawer 18, and the unit 16 can house a plurality of file drawers 18. The unit 16 can easily be completely or partially dismantled by removal of clips 14 and shells 12 can be removed from the unit 16 without disturbing the file drawers 18, which remain housed in their individual shells 12. disturbing the file drawers 18, which remain housed in their individual shells 12.

The frames 10 each include a continuous channel 20 that receives the edges of the open end 22 of a shell 12. The shells 12 illustrated also are formed with an enclosed rear (not shown), but need not be should removal of the drawer 18 from both or either the front or rear of the shell 12 be desired.

The edge of the open end 22 of the shell 12 is illustrated as being formed from free-sided flap extensions 26 of the shell sides 24, folded rearward and inwardly so as to lie adjacent the respective shell sides 24. The edge is therefore double layered and is received and engaged by the frame 20 that holds the flap extensions 26 flat against the sides 24 inside the shells 12.

The frames 10 are formed of a suitable material, such as plastic or metal or the like, and preferably are of the same peripheral dimensions as the shell 12. Normally the edge of the open-end 22 of the shell 12 would not fit within a frame 10 having the same peripheral dimensions, but here preferably the shell 12 is formed with notches 28 at its corners, hidden by the frame 10. The corner notches 28 allow the shell sides 24 to move inwardly of the open-end 22 and thereby conform to the dimensions of the frame's continuous channel 20.

The shells 12 are shown linked together, close to their corners, with clips 14. The clips 14 engage both the frames 10 and a portion of the shells 12 exposed behind the frames 10, and contribute to a firmer engagement of frame 10 to shell 12, as will be discussed more fully below. As illustrated by reference to the shell 12 shown in the lower right-hand position of the unit 16, a shell 12 may be linked both to a shell 12 above and a shell 12 at its side using only two clips 14. Since only one clip 14 is necessary to couple two shells 12, and each clip 14 occupies one corner of a shell 12, each shell 12 can be linked to four other shells 12, allowing construction of a unit without limit as to the number of shells 12 along either or both a vertical or horizontal line.

The drawers 18 are illustrated with full fronts 32 of suitable dimensions to be received by and to close the open end 22. The drawer sides 34 are cut-down, allowing easy access to the drawer contents (not shown). The drawers 18 are equipped with suitable handles or pulls 36, and are formed with a bottom wall 38 and back wall (not shown). The drawers 18 are preferably also formed of fiberboard, except for the hardware, as are the shells 12, and the sliding surface 38 provided here as in other channel frames is particularly advantageous for this economical construction material.

Referring now to FIG. 2 also, the clip 14 is preferably formed of a single length of wire into two spaced-apart irregular arms 40 and an intermediate connecting member 42. The arms 40 extend from the connecting member 42 initially slightly divergent from a parallel alignment with each other, then begin to converge, approaching the formation of a square-shaped figure, and forming internal shoulders 44. The arms 40 than again extend rearwardly from the connecting member 44 at a greater divergent angle from each other, and turn inwardly, back upon themselves to form end loops 46.

A clip 14 fits about two adjacent frames 10 at their corners, the connecting member 42 bridging the frame fronts 48, the internal shoulders 44 each engaging the rear 50 of a frame, and the end portion of the arms 40, including the end loops 46, engaging the shell 12 itself about the flap extension 26. The clip 14, to fit snuggly and provide a secure couple, should be somewhat resilient, such as a clip formed of medium weight wire.

Referring now to FIG. 3 also, the frame 10 includes a frame body 52 having two spaced-apart leg members 54 and an interconnecting base 56 forming the channel 20. A rigid bar 58 is positioned within the channel 20, between the leg members 54 and adjacent the base member 56. The rigid bar 58, preferably having a circular cross section, may be continuous, following the continuous channel 20, or may only extend along a portion of the channel 20 about which additional strength is desired. Alternatively, a frame 10 could include more than one rigid bar 58 disposed in various sections of the channel 20, but a single continuous rigid bar 58 is preferred.

When the frame 10 engages the shell 12, the rigid bar 58 is disposed forward of the edge 60 formed at the open end 22 of the shell 12 by the shell sides 24 and the folded-over flap extensions 26. This location of the rigid bar 68, with respect to the edge 60, distinctly differs from any similar reinforcing bar that is used internally. Such known reinforcing bars, of similar circular cross-section, would be disposed behind the edge 60, sandwiched between the flap extension 26 and shell side 24. These known reinforcing bars have been considered to provide greater structural strength to the open end 22 of a shell 12 than external frames, and such result has been attributed to the fact that the internal reinforcing bar was within the shell 12 itself. It is a surprising and unexpected feature of this invention that the placement of the rigid bars 58 of the frame 10 forward of the shell's edge 60 does not significantly diminish the structural strength it provides for the shell 12.

The channel 20 of the frame 10 receives the forward portion of the open end 22 of the shell 12 between its spaced-apart leg members 54. These leg members 54, as shown in FIG. 3, preferably extend a short distance forward of the connecting base member 56 so that the frame front 48 is formed by the external surface of the base member 56 and two opposed ridges 62 formed by the extension of the leg members 54. This frame front 48 provides not only a decorative feature, but this particular arrangement has a utilitarian function that will be discussed in detail below.

The outside leg member 54 of the frame 10 lies in substantially the same plane as the outside surface of the shell sides 24 and the shell's edge 60 must be disposed in a different plane so as to fit within the frames continuous channel 20 as shown. This is accomplished by providing shell corner notches 28 as will be discussed below.

When two framed shells 12 are positioned adjacent one another so that their frames 10 are coextensive along one side, they can be linked together by a clip 14 as illustrated best in FIG. 3. The clip's connecting member 42 bridges the frames 10, extending across the fronts 48 of both. The clip's arms 40 extend about the opposite leg members 54 of each frame 10, holding the frames 10 together. The flap extensions 26 of the shell 12 are cut away about the position in which the internal arm shoulder 44 of a clip 14 will be positioned in use. The internal arm shoulder 44 is then disposed in this slot 64. The end loop 46 of the clip 14 extends beyond the slot 64 and is in frictional engagement with the flap extension 26. This end loop 46 is not only a safety feature because it prevents scratching of the apparatus or a person handling the clip 14, but also is a means for grasping the clip 14 at its rearmost end when the clip 14 is to be removed, a difficult procedure if the end of the clip 14 were lying flat against the flap extension 26.

Considering now FIG. 4, there is shown an exploded view of the frame body 52, the rigid bar 58, and the open end 22 of the shell 12. FIG. 4 illustrates particularly well the cutaway portion of slot 64 of the flap extension 26 wherein the internal arm shoulder 44 of a clip 14 would rest. The slots 64, together with the external corner notches 28 allow the shell edge 60 to flex and conform to the dimensions of the frame. FIG. 4 additionally well illustrates slots 66 in the flap extension 26 that receive fish-hook flanges 68 (not shown in FIG. 4) on the frame 10 for securing the engagement of the frame 10 to the shell 12 as is well known to those of ordinary skill in the art.

Figure 5:
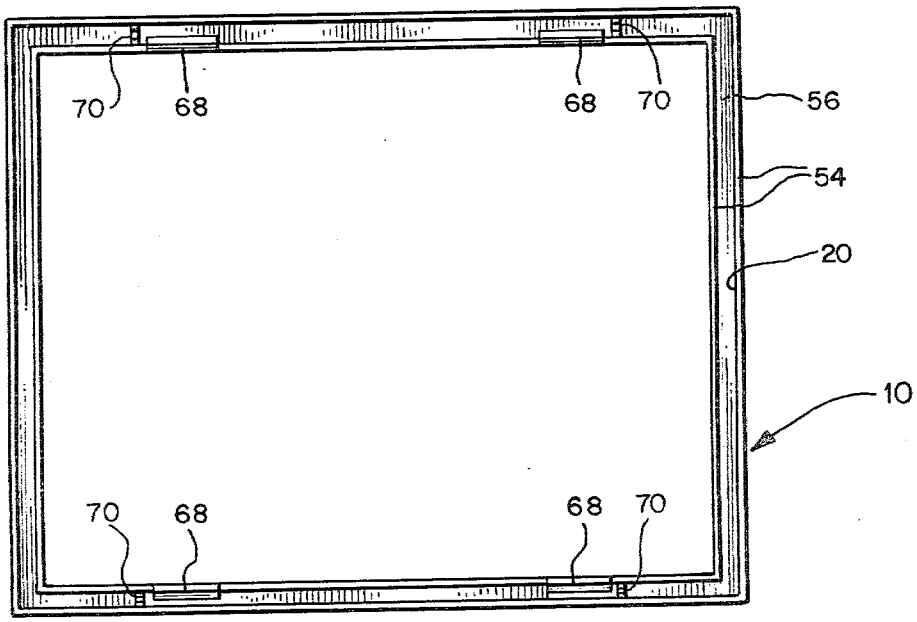
FIG. 5 is a back elevational view of a frame body of the frame illustrated in FIG. 1, taken along line 5—5 of FIG. 4.

Considering FIG. 5, there is illustrated the internal portions of the frame body 52 alone from a rear, elevational view. Four fish-hook flanges 68 are illustrated, two on the top and two on the bottom of the frame body 52, formed integrally with the inward leg member 54. Also illustrated are four pairs of flanges 70 positioned behind the fish-hook flanges 68 close to the base member 56 which secures the rigid bar 58 so that it isn't free to move during the handling of the frame 10. The frame body 52 should be constructed of sufficiently flexible material, such as plastic, to allow the fish-hook flanges 68 movement necessary for securement into the slots 66 and to allow the rigid bar 58 to pass into the channel 20. The pairs of flanges 70 must also be sufficiently flexible to receive the rigid bar 58. The entire frame body 52 is preferably formed, as an integral unit, of a plastic, and together with the rigid bar 58, form a frame 10 of greater durability and strength than encountered in external channeled frames made of metal or other more expensive materials.

Figure 6:
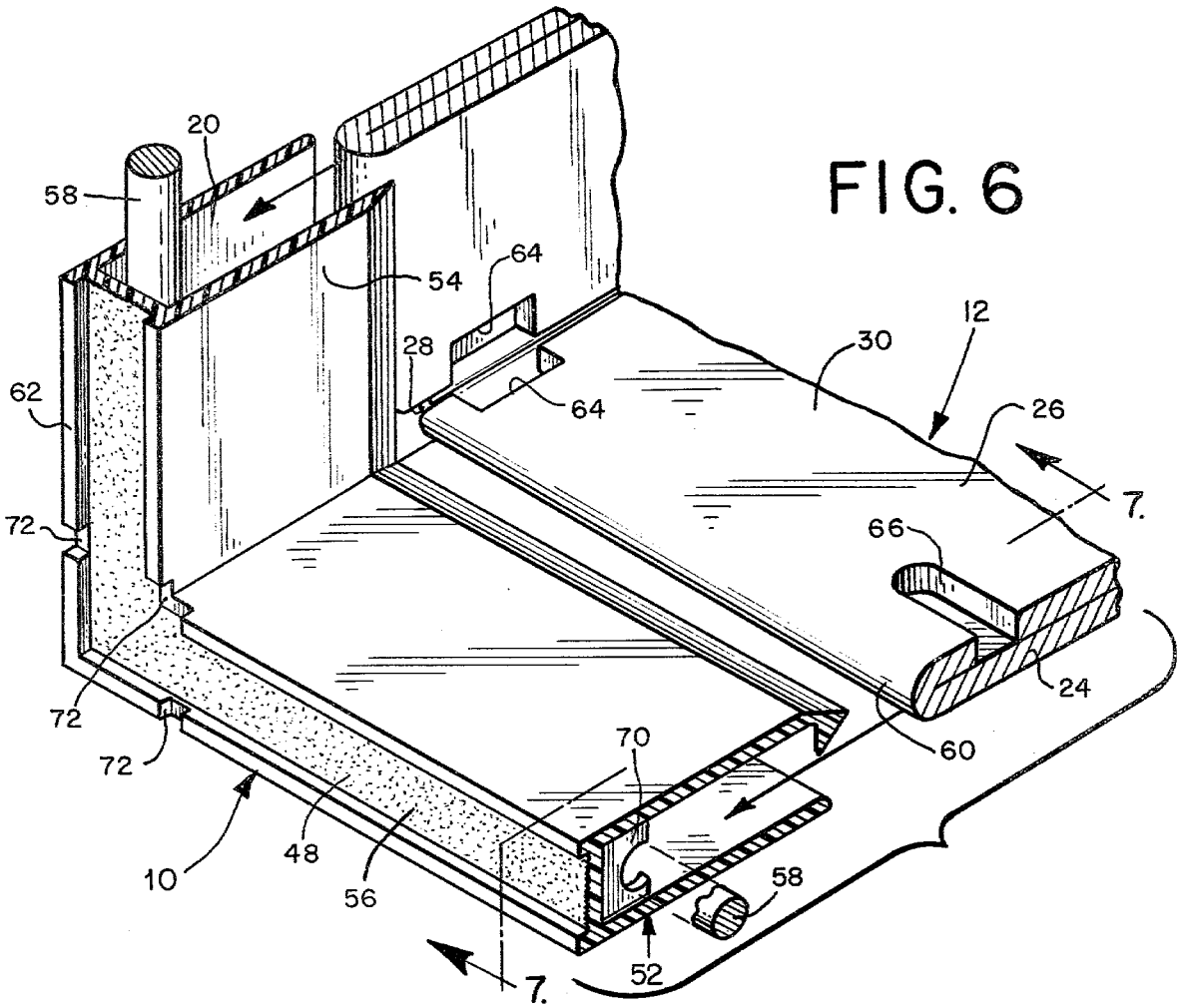
FIG. 6 is an exploded enlarged fragmentary view of a corner of the frame and compartment illustrated in FIG. 1.

Referring now to FIG. 6, there is illustrated, in closeup, a corner of the frame 10 with three notches 72 in the ridges 62 of the frame front 48. These notches 72 are formed on the ridges, one notch 72 being at the intersection of the sides of the frame body 52, on the inward ridge, and the other two notches 72 being aligned with the first notch in a horizontal and vertical direction, respectively. These notches 72 provide a groove for a clip 14 so that the connecting member 42 of the clip 14 lies in close proximity to the base member 56 of the frame body 52 and is not held spaced-apart from the base member 56 by the ridges 62. The notches 72 in the ridges 62 prevent a clip 14 from sliding along the frame body 52. A clip 14 can be secured either along the vertical or horizontal through these respective notches 72.

Figure 7:
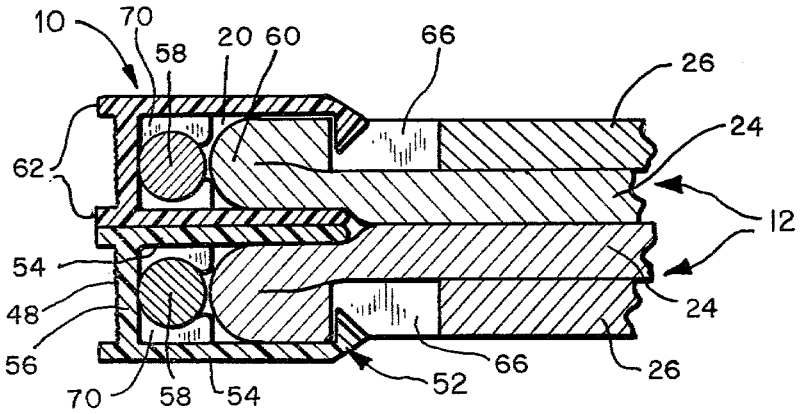
FIG. 7 is a cross sectional view of the frame and compartment illustrated in FIG. 1, taken along line 7—7 of FIG. 6.

Referring to FIG. 7, there is illustrated in cross section the fish-hook flanges 68 mentioned above engaging the slots 66 of the receptive shells 12. The frame body 52, particularly its leg members 54 and the fish-hook flanges 68 themselves, are sufficiently flexible to allow manual dislodgement of the fish-hook flanges 68 from the slots 66 when desired.

INDUSTRIAL APPLICATION

The frame and combination of frame and shell, and the further combination of frame, shell and means for linking shells together of the present invention are used to store file drawers or the like singly or in a unit comprised of a plurality of shelves. The storage units formed therefrom, particularly when made of fiberboard, not only have an attractive appearance, but are relatively inexpensive and yet sufficiently durable to withstand use conditions of offices, factories, and the like. The frames reinforce the open end of the shells, the portion of the shells subject to the most use, and also strengthen the entire shell so that it can withstand the weight of another shell, a drawer, and its contents above it. The linking means allows the shells to be arranged together as a unit in the manner desired.

While several embodiments described herein are at present considered to be preferred, it is understood that various modifications and improvements may be made therein, and it is intended to cover in the appended claims all such modifications and improvements as fall within the true spirit and scope of the invention.

What is desired to be claimed and secured by Letters Patent of the United States is:

1. An improved framed shell housing comprising, in combination:

a fiberboard shell having at least three side wall panels;

said side wall panels being formed with hingedly connected extension panels, folded inwardly so as to lie adjacent their respective side wall panels, said side wall panels and their respective extension panels forming forward edges about their hinged connections, and said forward edges of said side wall panels forming collectively an open end of said shell;

wherein said shell further includes a notch at each corner formed by said side wall panels at said open end of said shell; and a continuous peripheral frame for said open end of said shell, said frame having substantially the same peripheral dimensions as a periphery of said shell defined by said side wall panels rearward of said open end, said frame including, in combination, a first and a second spaced-apart leg member, a base member, said base member interconnecting said leg members and thereby forming a channel, and a continuous rigid bar, said rigid bar being disposed within said channel adjacent said base member, said frame receiving said forward edges within said channel and said rigid bar being disposed between said base member and said forward edges.

2. The framed shell housing of claim 1 wherein said shell includes four of said side wall panels.

3. The framed shell housing of claim 2 further including an inner and an outer ridge on said frame formed as extensions of said leg members which protrude beyond said base member, which inner ridge is discontinuous forming an inner notch at least at one corner and said outer ridge is discontinuous at least at one point opposite said inner notch, forming an outer notch said notches being adapted to receive a means for linking a plurality of said framed shells in the form of a double armed clip which arms are adapted to extend about adjacent frames and be held against sliding along said frame front by said notches.

4. The framed shell of claim 2 wherein said rigid bar is of substantially circular cross section.

5. The framed shell housing of claim 3 wherein said shell is formed with at least one internal slot rearward of said frame at a corner formed by two of said side wall panels, said slot being adapted to receive a portion of said means for linking a plurality of said framed shells wherein said clip is formed with at least one arm having an internal shoulder which is substantially received by said slot when said clip arms extend about adjacent frames of adjacent shells to couple said adjacent shells.

6. A storage unit comprising, in combination:

a plurality of framed shell housings as defined in claim 5, linked together along at least a single-direction alignment by a plurality of said clips.

7. A storage unit comprising, in combination:

a plurality of framed shell housings as defined in claim 5, linked together along more than one direction by a plurality of said clips.

8. An improved framed shell housing comprising, in combination:

a fiberboard shell having at least three side wall panels;

said side wall panels being formed with hingedly connected extension panels, folded inwardly so as to lie adjacent their respective side wall panels, said side wall panels and their respective extension panels forming forward edges about their hinged connections, and said forward edges of said side wall panels forming collectively an open end of said shell; and a continuous peripheral frame for said open end of said shell, said frame having substantially the same peripheral dimensions as a periphery of said shell defined by said side wall panels rearward of said open end, said frame including, in combination, a first and a second spaced-apart leg member, a base member, said base member interconnecting said leg members and thereby forming a channel, and a continuous rigid bar, said rigid bar being disposed within said channel adjacent said base member, said frame receiving said forward edges within said channel and said rigid bar being disposed between said base member and said forward edges.

* * * * *

UNITED STATES PATENT AND TRADEMARK OFFICE

CERTIFICATE OF CORRECTION

PATENT NO. 4,239,306

DATED December 16, 1980

INVENTOR(S) Gerald R. Klaus

It is certified that error appears in the above—identified patent and that said Letters Patent is hereby corrected as shown below:

Column 2, line 51, please delete "if", second occurrence, and substitute therefor --in--.

Column 2, line 54, please delete "chip" and substitute therefor --clip--.

Column 3, line 34, please delete "14", second occurrence, and substitute therefor --12--.

Column 3, line 42, please delete "disturbing the file drawers 18, which remain housed in their individual shells 12.".

Column 5, line 20, please delete "frames" and substitute therefor --frame's--.

Column 5, line 51, please delete "66" and substitute therefor --64--.

UNITED STATES PATENT AND TRADEMARK OFFICE

CERTIFICATE OF CORRECTION

PATENT NO. 4,239,306

DATED December 16, 1980

INVENTOR(S) Gerald R. Klaus

It is certified that error appears in the above—identified patent and that said Letters Patent is hereby corrected as shown below:

Column 5, line 63, please delete "secures" and substitute therefor --secure--.

Column 5, line 67, please delete "66" and substitute therefor --64--.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*